US007544136B2

(12) United States Patent
Tsai

(10) Patent No.: US 7,544,136 B2
(45) Date of Patent: Jun. 9, 2009

(54) GOLF CLUB HEAD STRUCTURE

(75) Inventor: Chia-Jen Tsai, Kaohsiung (TW)

(73) Assignee: Advanced International Multitech Co., Ltd., Kaohsiung (TW)

( * ) Notice: Subject to any disclaimer, the term of this patent is extended or adjusted under 35 U.S.C. 154(b) by 293 days.

(21) Appl. No.: 11/644,941

(22) Filed: Dec. 26, 2006

(65) Prior Publication Data

US 2007/0178990 A1 Aug. 2, 2007

(30) Foreign Application Priority Data

Jan. 27, 2006 (TW) ..... 95202103 U

(51) Int. Cl.
*A63B 53/04* (2006.01)

(52) U.S. Cl. ..... 473/342; 473/349; 473/350

(58) Field of Classification Search ..... 473/324–350
See application file for complete search history.

(56) References Cited

U.S. PATENT DOCUMENTS

| | | | | |
|---|---|---|---|---|
| 4,749,197 | A * | 6/1988 | Orlowski | 473/342 |
| 4,884,808 | A * | 12/1989 | Retzer | 473/288 |
| 5,993,329 | A * | 11/1999 | Shieh | 473/329 |
| 6,050,904 | A * | 4/2000 | Kuo | 473/342 |
| 6,319,149 | B1 * | 11/2001 | Lee | 473/342 |
| 6,506,129 | B2 * | 1/2003 | Chen | 473/329 |
| 6,648,774 | B1 * | 11/2003 | Lee | 473/342 |
| 6,746,342 | B1 * | 6/2004 | Hsieh | 473/342 |
| 6,749,524 | B1 * | 6/2004 | Chen | 473/342 |
| 6,991,559 | B2 * | 1/2006 | Yabu | 473/332 |
| 7,121,958 | B2 * | 10/2006 | Cheng et al. | 473/345 |
| 7,128,947 | B2 * | 10/2006 | Hou | 427/327 |
| 7,258,628 | B2 * | 8/2007 | Huang et al. | 473/342 |
| 7,371,188 | B2 * | 5/2008 | Chen | 473/329 |
| 7,431,665 | B2 * | 10/2008 | Sugimoto | 473/342 |
| 2003/0139227 | A1 * | 7/2003 | Sugimoto | 473/342 |
| 2004/0097301 | A1 * | 5/2004 | Lee | 473/342 |
| 2004/0185960 | A1 * | 9/2004 | Chen | 473/342 |
| 2005/0101406 | A1 * | 5/2005 | Hirano | 473/342 |
| 2006/0135285 | A1 * | 6/2006 | Hou et al. | 473/342 |
| 2006/0194645 | A1 * | 8/2006 | Sugimoto | 473/342 |
| 2006/0252576 | A1 * | 11/2006 | Lo | 473/342 |
| 2008/0125245 | A1 * | 5/2008 | Yang et al. | 473/342 |

* cited by examiner

*Primary Examiner*—Sebastiano Passaniti
(74) *Attorney, Agent, or Firm*—Morris, Manning & Martin LLP; Tim Tingkang Xia

(57) ABSTRACT

A golf club head structure is provided, which includes a body and a striking plate. The body is formed with a first frame opening portion and a second frame opening portion on one side surface. The cross-section of the first frame opening portion is a C-shaped frame opening. Furthermore, the striking plate is formed with a frame-opening joining portion and a frame-opening recessed portion corresponding to the body. The frame-opening joining portion and the frame opening recessed portion are snapped respectively with the first frame opening portion and the second frame opening portion, thereby fixing the striking plate into the body. By implementing the golf club head structure, a joining structure with a preferred strength is provided, thereby effectively enhancing the bearing of the striking stress.

11 Claims, 6 Drawing Sheets

GOLF CLUB HEAD STRUCTURE

CROSS-REFERENCE TO RELATED APPLICATIONS

This non-provisional application claims priority under 35 U.S.C. § 119(a) on Patent Application No(s). 095202103 filed in Taiwan, R.O.C. on Jan. 27, 2006, the entire contents of which are hereby incorporated by reference.

BACKGROUND OF THE INVENTION

1. Field of Invention

The present invention relates to a golf club head structure, and more particularly, to a golf club head structure for providing a joining structure with a preferred strength and made by different materials.

2. Related Art

In the conventional golf club head construction, a striking plate is mostly joined by an embedding or welding method, which has many disadvantages, for example, the embedding process easily results in the deformation of the striking plate. If the club head body and the striking plate made by different materials are weld together, the problem of insufficient welding compatibility occurs. If the used welding process is a hard welding or a high energy welding (e.g., laser welding, plasma), it takes much time to perform vacuum pumping or inert gas processing, so as to protect the metal surface from generating oxidative stains.

In order to eliminate the defects of the joining construction for the striking plate of the golf club head, an adhering joining technology directly using a high strength resin under a normal temperature is developed in the conventional art. Referring to FIG. 1, a golf club head includes a club head body P10 and a striking plate P20. The club head body P10 is recessed to form a frame opening P11 to accommodate the striking plate P20, and an outer peripheral edge P21 and a joining portion P22 of the striking plate P20 are adhered on an inner peripheral edge P111 and a joining portion P112 of the frame opening P11, so as to quickly finish assembling under room temperature, and thereby achieving the conventional composite striking plate structure.

However, since it is limited by the upper limit of the adhering strength for the high strength resin adhesive, and the frame opening P11 of the club head body P10 and the striking plate P20 do not have any special joining structure design, although the adhering construction of the club head body P10 and the striking plate P20 accelerates the manufacturing process, it cannot provide sufficient joining strength, when joining the club head body P10 with the striking plate P20, for bearing the striking stress. In the conventional art, the club head body P10 and the striking plate P20 are mostly made by the same material, which is another disadvantage.

Therefore, since the club head body and the striking plate of the conventional golf club head do not have any special joining structure design, the joining strength is not desired, which cannot effectively bear the striking stress, and it is also limited by the fact that both of them are made by the same material. Therefore, it has become an issue for research and development in this field to redesign a golf club head structure having a special joining structure to increase the joining strength and prolong the service life of the golf club head.

SUMMARY OF THE INVENTION

In view of the problem of the conventional technology, the present invention provides a golf club head structure, for solving the problems of the conventional joining structure that the strength is not desired and it cannot effectively bear the striking stress, and also eliminating the defect of the conventional golf club head structure that it is limited by the fact that most of the conventional golf club heads are fabricated by the same material.

In order to achieve the above object, the present invention provides a golf club head structure, which comprises a body and a striking plate. The body has a first frame opening portion and a second frame opening portion on one side surface. The cross-section of the first frame opening portion is a C-shaped frame opening. Furthermore, the striking plate has a frame-opening joining portion and a frame-opening recessed portion corresponding to the body. The frame-opening joining portion and the frame-opening recessed portion are snapped respectively with the first frame opening portion and the second frame opening portion, thereby fixing the striking plate into the body.

By implementing the golf club head structure of the present invention, at least the following functions can be achieved.

First, the present invention provides a golf club head structure, and by implementing the golf club head structure, a variety of different materials are used and bonded together, and a joining structure with a preferred strength is provided, thereby enhancing the effect for the golf club head to bear the striking stress; because the striking plate and the body are closely joined, the golf club head with high anti-tee off is obtained.

Second, the present invention provides a golf club head structure, and by using the golf club head structure, the defects of the heat affecting region and the non-uniformity of the hardness of the panel caused by the conventional welding processing are avoided. In the present invention, the forming process that cannot be achieved by the conventional welding process is performed on the back of the striking plate.

In order to further understand the objectives, construction, features, and functions of the present invention, the detailed descriptions are given bellow through the relevant embodiments and accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

Figure 1:
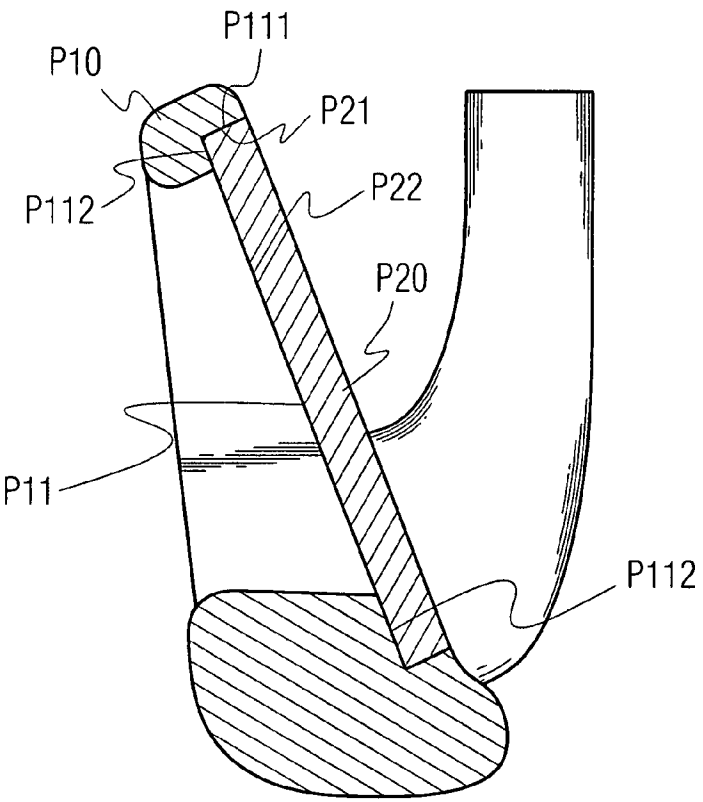
FIG. 1 (PRIOR ART)
FIG. 1 is a schematic view of a conventional golf club head structure.
Figure 2B:
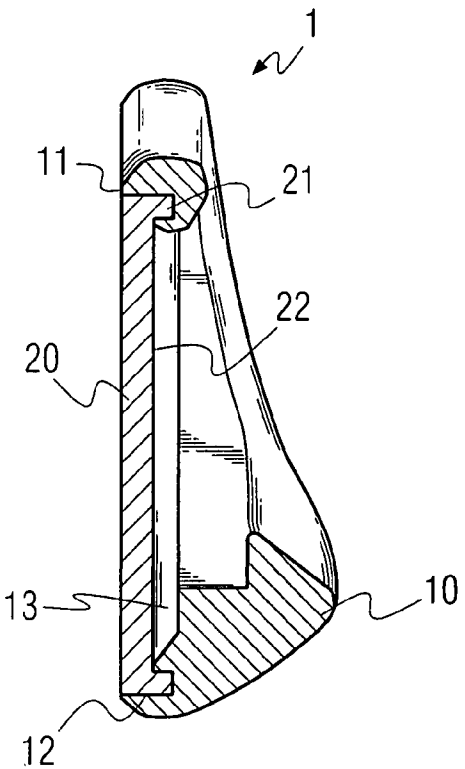
FIG. 2B is a schematic cross-sectional view of the first configuration of the golf club head structure of the present invention of FIG. 2A after being assembled.
Figure 2A:
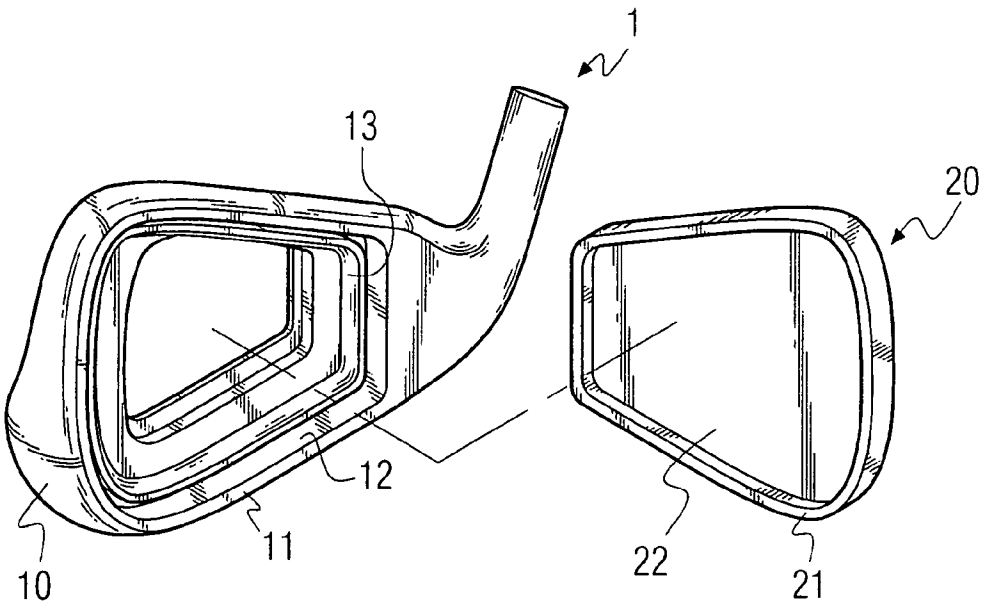
FIG. 2A is a schematic view of a first configuration of a golf club head structure of the present invention.

Firstly, referring to FIGS. 2A and 2B, the present invention provides a golf club head having a high specific gravity composite weighted body. The golf club head 1 includes a body 10 and a striking plate 20.

Referring to FIGS. 2A and 2B, the present invention provides a golf club head structure. In a first configuration of the golf club head 1, the body 10 has a side surface 11 with a first frame opening portion 12 and a second frame opening portion 13 formed thereon, and the cross-section of the first frame opening portion 12 is a C-shaped frame opening. The striking plate 20 is formed with a frame-opening joining portion 21 and a frame-opening recessed portion 22 corresponding to the body 10. The frame-opening joining portion 21 is snapped with the first frame opening portion 12, and the frame-opening recessed portion 22 is snapped with the second frame opening portion 13, thereby fixing the striking plate 20 into the body 10, so as to finish the golf club head 1.

Figure 3B:
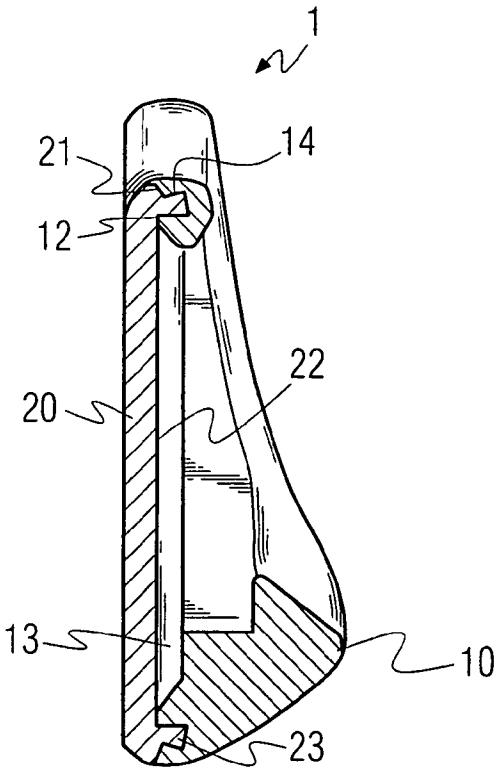
FIG. 3B is a schematic cross-sectional view of the second configuration of the golf club head structure of the present invention of FIG. 3A after being assembled.
Figure 3A:
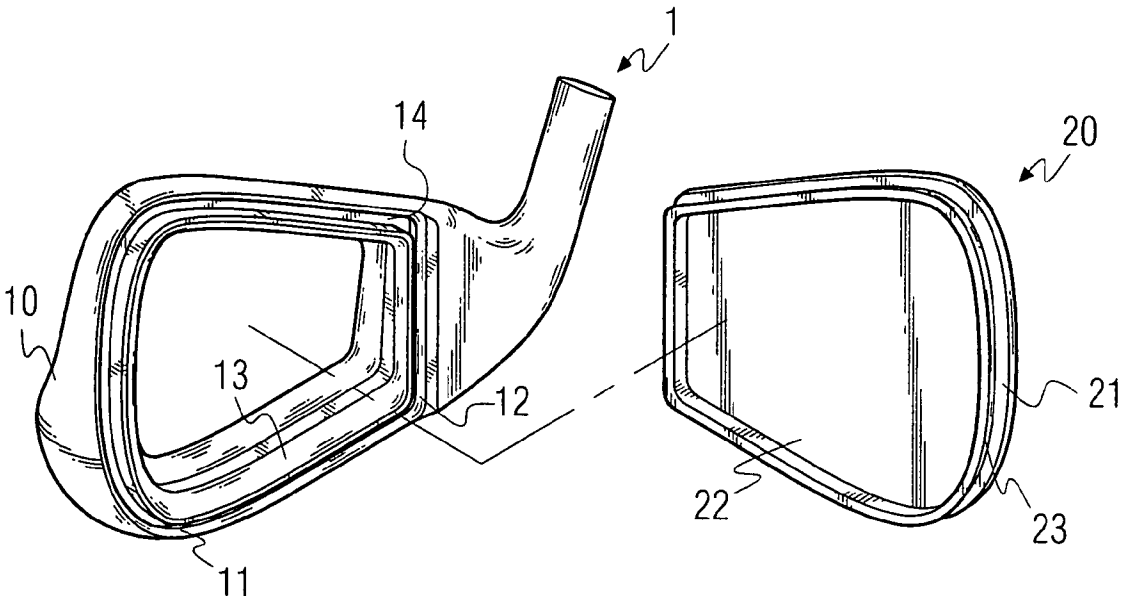
FIG. 3A is a schematic view of a second configuration of the golf club head structure of the present invention.

Furthermore, referring to FIGS. 3A and 3B, the present invention provides a golf club head structure. In a second configuration of the golf club head 1, the body 10 similarly has a side surface 11 with a first frame opening portion 12 and a second frame opening portion 13 formed thereon, and the cross-section of the first frame opening portion 12 is a C-shaped frame opening. A snapping groove 14 is further formed between the first frame opening portion 12 and the second frame opening portion 13 of the body 10. The striking plate 20 is not only formed with a frame-opening joining portion 21 and a frame-opening recessed portion 22 corresponding to the body 10; but also formed correspondingly to a snapping portion 23. The snapping portion 23 has a slope, such that the frame-opening joining portion 21 and the frame-opening recessed portion 22 are snapped respectively with the first frame opening portion 12 and the second frame opening portion 13, and the snapping portion 23 is snapped with the snapping groove 14, thereby fixing the striking plate 20 into the body 10, so as to finish the golf club head 1.

Figure 4B:
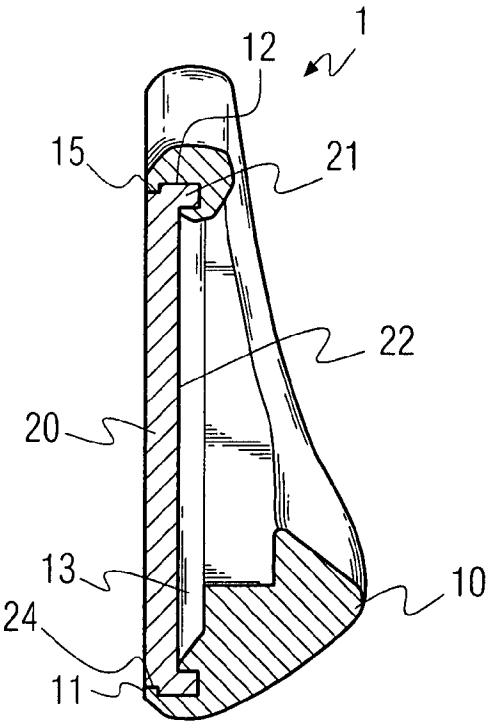
FIG. 4B is a schematic cross-sectional view of the third configuration of the golf club head structure of the present invention of FIG. 4A after being assembled.
Figure 4A:
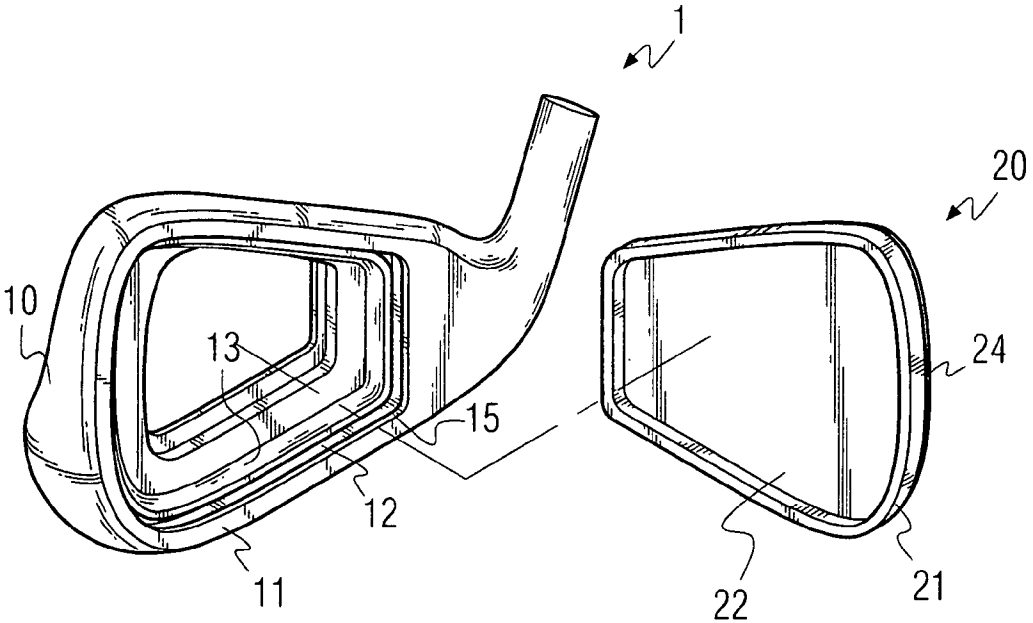
FIG. 4A is a schematic view of a third configuration of the golf club head structure of the present invention.
Figure 5B:
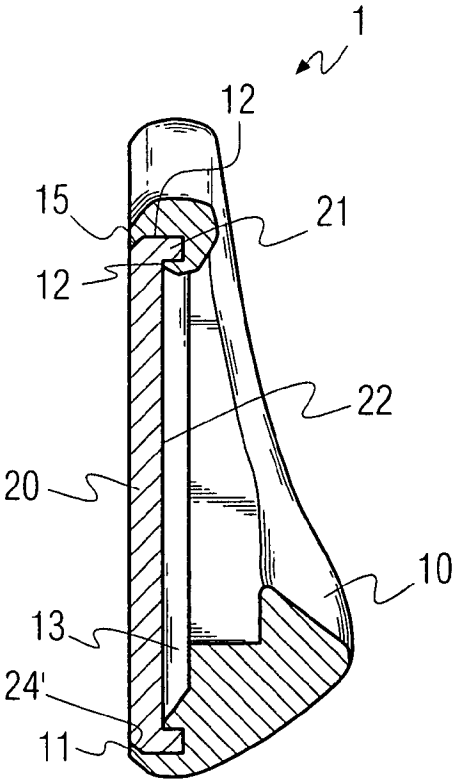
FIG. 5B is a schematic cross-sectional view of the fourth configuration of the golf club head structure of the present invention of FIG. 5A after being assembled.
Figure 5A:
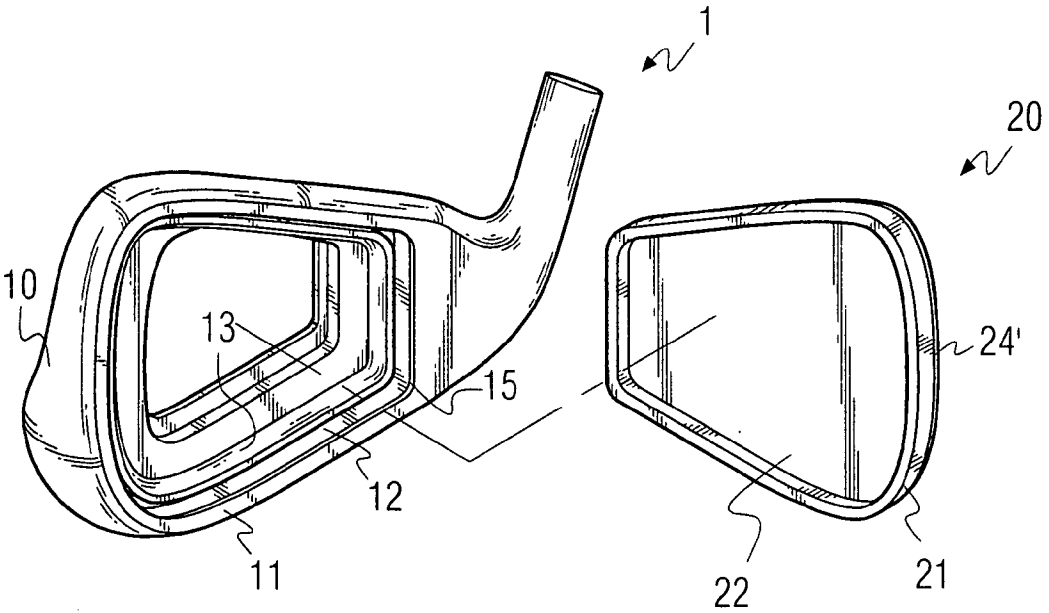
FIG. 5A is a schematic view of a fourth configuration of the golf club head structure of the present invention.

Furthermore, referring to FIGS. 4A and 4B, the present invention provides a golf club head structure. In a third configuration of the golf club head 1, the body 10 similarly has a side surface 11 with a first frame opening portion 12 and a second frame opening portion 13 formed thereon, and the cross-section of the first frame opening portion 12 is a C-shaped frame opening. The first frame opening portion 12 of the body 10 is further formed with a snapping flange 15. The striking plate 20 is not only formed with a frame-opening joining portion 21 and a frame-opening recessed portion 22 corresponding to the body 10, but also formed with a snapping protruded portion 24 on the back side of the frame-opening joining portion 21, such that the frame-opening joining portion 21 and the frame-opening recessed portion 22 are snapped respectively with the first frame opening portion 12 and the second frame opening portion 13, and the snapping protruded portion 24 is snapped with the snapping flange 15, thereby fixing the striking plate 20 into the body 10, so as to finish the golf club head 1. In addition, referring to FIGS. 5A and 5B, the present invention provides a golf club head structure. In a fourth configuration of the golf club head 1, similarly to the third configuration of the golf club head 1; however, the snapping protruded portion 24' has a slope. Definitely, the frame-opening joining portion 21 and the frame-opening recessed portion 22 are snapped respectively with the first frame opening portion 12 and the second frame opening portion 13, and the snapping protruded portion 24' is snapped with the snapping flange 15, thereby fixing the striking plate 20 into the body 10, so as to finish the golf club head 1.

Figure 6B:
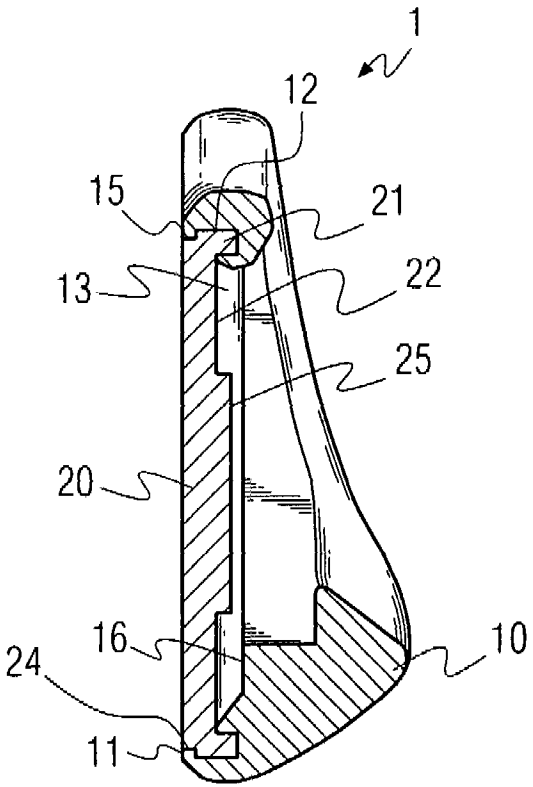
FIG. 6B is a schematic cross-sectional view of the fifth configuration of the golf club head structure of the present invention of FIG. 6A after being assembled.
Figure 6A:
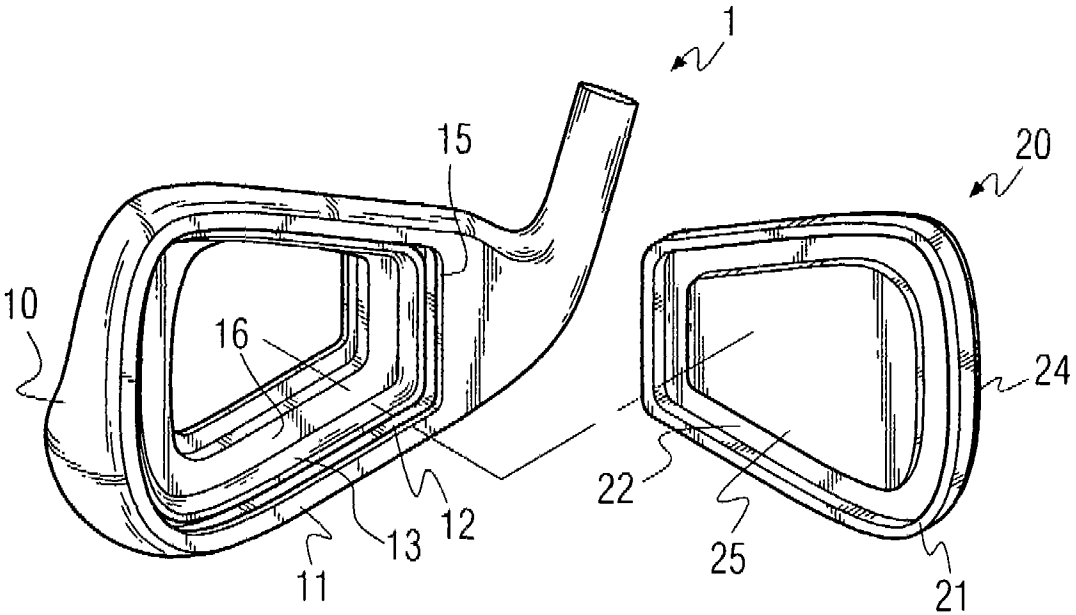
FIG. 6A is a schematic view of a fifth configuration of the golf club head structure of the present invention.

Finally, referring to FIGS. 6A and 6B, the present invention provides a golf club head structure. In a fifth configuration of the golf club head 1, the body 10 similarly has a side surface 11 with a first frame opening portion 12 and a second frame opening portion 13 formed thereon, and the cross-section of the first frame opening portion 12 is a C-shaped frame opening. The first frame opening portion 12 and the second frame opening portion 13 of the body 10 are respectively formed with a snapping flange 15 on the first frame opening portion 12 and a snapping recess 16 on the second frame opening portion 13. The striking plate 20 is formed with a frame-opening joining portion 21 and a frame-opening recessed portion 22 corresponding to the body 10. The frame-opening joining portion 21 and the frame-opening recessed portion 22 are formed correspondingly to a snapping protruded portion 24 on the back side of the frame-opening joining portion 21 and a snapping bump 25 on the frame-opening recessed portion 22 respectively. The frame-opening joining portion 21 and the frame-opening recessed portion 22 are snapped respectively with the first frame opening portion 12 and the second frame opening portion 13, and the snapping protruded portion 24 and the snapping bump 25 are snapped respectively with the snapping flange 15 and the snapping recess 16, thereby fixing the striking plate 20 into the body 10, so as to finish the golf club head 1.

The present invention provides a golf club head structure. The striking plate 20 and the body 10 of the golf club head 1 are joined by a mechanical joining method or an adhering method. Furthermore, the body 10 and the striking plate 20 are made by different materials or the same material. The different materials include a foam porous material, with a density of 0.2 to 3 g/cm$^3$. The foam porous material includes copper, aluminum, aluminum alloy, titanium, titanium alloy, copper-tungsten alloy, aluminum-magnesium alloy, copper-molybdenum alloy, or metal-based ultra-high thermal conductive composite material alloy. Furthermore, the foam porous material further includes a cladding layer, and the cladding material of the cladding layer includes carbon fiber, titanium alloy, aluminum alloy, magnesium alloy, polyurethane (PU), thermoplastic polyurethane (TPU), tungsten rubber, or plastic. In addition, the same material includes titanium alloy, stainless steel, iron, aluminum, manganese, or ductile iron material.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf club head structure, comprising:

a body, having a first frame opening portion and a second frame opening portion formed on one side surface of said body, wherein a cross-section of said first frame opening portion is a C-shaped frame opening, wherein said first frame opening portion and said second frame opening portion of said body are further formed respectively with a snapping flange on said first frame opening portion and a snapping recess on said second frame opening portion; and a striking plate, having a frame-opening joining portion and a frame-opening recessed portion formed corresponding to said body, wherein said frame-opening joining portion and said frame-opening recessed portion are snapped respectively with said first frame opening portion and said second frame opening portion, thereby fixing said striking plate into said body, wherein said frame-opening joining portion and said frame-opening recessed portion of said striking plate are further formed correspondingly to a snapping protruded portion on a back side of said frame-opening joining portion and a snapping bump on said frame-opening recessed portion, said frame-opening joining portion and said frame-opening recessed portion are snapped respectively with said first frame opening portion and said second frame opening portion, and said snapping protruded portion and said snapping bump are snapped respectively with said snapping flange and said snapping recess, thereby fixing said striking plate into said body.

2. The golf club head structure as claimed in claim 1, wherein a snapping groove is further formed between said first frame opening portion and said second frame opening portion of said body, a snapping portion is formed correspondingly to said frame-opening joining portion and said frame-opening recessed portion of said striking plate, said frame-opening joining portion and said frame-opening recessed portion are snapped respectively with said first frame opening portion and said second frame opening portion, and said snapping portion is snapped with said snapping groove, thereby fixing said striking plate into said body.

3. The golf club head structure as claimed in claim 1, wherein said striking plate is joined by a mechanical joining method or an adhering method with said body.

4. The golf club head structure as claimed in claim 1, wherein said body and said striking plate are made by different materials.

5. The golf club head structure as claimed in claim 4, wherein said different materials include a foam porous material.

6. The golf club head structure as claimed in claim 5, wherein said foam porous material includes copper, aluminum, aluminum alloy, titanium, titanium alloy, copper-tungsten alloy, aluminum-magnesium alloy, copper-molybdenum alloy, or metal-based ultra-high thermal conductive composite material alloy.

7. The golf club head structure as claimed in claim 5, wherein the density of said foam porous material is 0.2 to 3 g/cm3.

8. The golf club head structure as claimed in claim 5, wherein said foam porous material further comprises a cladding layer.

9. The golf club head structure as claimed in claim 5, wherein the cladding material of said cladding layer includes carbon fiber, titanium alloy, aluminum alloy, magnesium alloy, polyurethane (PU), thermoplastic polyurethane (TPU), tungsten rubber, or plastic.

10. The golf club head structure as claimed in claim 1, wherein said body and said striking plate are made by the same material.

11. The golf club head structure as claimed in claim 10, wherein said same material includes titanium alloy, stainless steel, iron, aluminum, manganese, or ductile iron material.

* * * * *